US006853148B2

(12) United States Patent
Yamazaki et al.

(10) Patent No.: US 6,853,148 B2
(45) Date of Patent: Feb. 8, 2005

(54) IMAGE-FORMING APPARATUS AND METHOD OF MANUFACTURING THE SAME

(75) Inventors: Koji Yamazaki, Kanagawa (JP); Tomoya Onishi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 69 days.

(21) Appl. No.: 10/290,179

(22) Filed: Nov. 8, 2002

(65) Prior Publication Data

US 2003/0067275 A1 Apr. 10, 2003

Related U.S. Application Data

(62) Division of application No. 09/903,712, filed on Jul. 13, 2001, now Pat. No. 6,509,691.

(30) Foreign Application Priority Data

Jul. 18, 2000 (JP) ..... 2000-217714
Jul. 10, 2001 (JP) ..... 2001-209558

(51) Int. Cl.[7] ..... G09G 3/10; H01J 9/02

(52) U.S. Cl. ..... 315/169.3; 313/495; 315/169.1; 315/169.4

(58) Field of Search ..... 315/169.3, 169.1–169; 313/495, 336–341, 496; 345/60, 65, 67, 69

(56) References Cited

U.S. PATENT DOCUMENTS 5,532,548 A 7/1996 Spindt et al. ..... 313/422
5,929,560 A 7/1999 Trujillo et al. ..... 313/495
5,982,082 A 11/1999 Janning ..... 313/336
6,267,636 B1 * 7/2001 Onishi et al. ..... 445/6
6,411,559 B1 * 6/2002 Yokozeki ..... 365/205
6,426,596 B1 * 7/2002 Yamamoto et al. ..... 315/169.1
6,435,928 B1 * 8/2002 Tsukamoto ..... 445/24
6,486,610 B2 * 11/2002 Kojima et al. ..... 315/169.3
6,777,868 B1 * 8/2004 Kosaka et al. ..... 313/495

* cited by examiner

*Primary Examiner*—Don Wong
*Assistant Examiner*—Chuc Tran
(74) *Attorney, Agent, or Firm*—Fitzpatrick, Cella, Harper & Scinto

(57) ABSTRACT

An image-forming apparatus of the present invention includes: a vacuum container constituted by disposing in opposition to each other a rear plate with an electron source formed thereon, and a face plate having an image display region provided with at least phosphors for being irradiated with electrons emitted from the electron source to form an image and anodes disposed on the phosphors; anode potential supplying means for supplying an electric potential higher than that of the electron source to the anode; at least one electroconductive member provided at a site outside of the image display region on an inner surface of the face plate; potential supplying means for supplying to the electroconductive member an electric potential at a level between a lowest electric potential of those which are applied to the electron source and an electric potential applied to the anode; first and second resistant members electrically connected between the anode and the electroconductive members, having resistances higher than that of the anode and having different resistances from each other, wherein the anode, the first resistant member, the second resistant member, and the electroconductive member are electrically connected in series.

17 Claims, 9 Drawing Sheets

IMAGE-FORMING APPARATUS AND METHOD OF MANUFACTURING THE SAME

This application is a division of application Ser. No. 09/903,712, filed Jul. 13, 2001, now U.S. Pat. No. 6,509,691 B2, issued Jan. 21, 2003.

BACKGROUND OF THE INVENTION

1. Field of the Invention

The present invention relates to an image-forming apparatus such as a display apparatus using an electron beam, and a method of manufacturing the same.

2. Related Background Art

Conventionally, as an image-forming apparatus using electron-emitting devices, a plane type electron beam display panel is known in which an electron source substrate with a number of cold cathode devices formed thereon and an anode substrate provided with anode electrodes and phosphors are opposed to each other in parallel, and an inside thereof is exhausted to a vacuum. For example, U.S. Pat. No. 5,066,883 and the like disclose such an image-forming apparatus using surface conduction electron-emitting devices. A plane type electron beam display panel using surface conduction electron-emitting devices can be rendered light-weight and have a large screen, compared with a cathode ray tube (CRT) that is widely used at the present. Such a plane type electron beam display panel can also provide a higher quality image with higher brightness, compared with other plane type display panels such as a plane type display panel using liquid crystal, a plasma display, and an electroluminescent display.

In a conventional plane type electron beam display panel as an exemplary image forming apparatus using electron-emitting devices, a vacuum container is composed of a rear plate, a face plate, and a side wall (supporting frame). Electron-emitting devices are provided on an electron source substrate of the rear plate, and phosphors and anode electrodes (metal back, etc.) are provided on the face plate, in such a manner that one phosphor corresponds to one electron-emitting device. Furthermore, the electron-emitting devices are connected to row-directional wirings and column-directional wirings. In the electron beam display panel with the above-mentioned structure, in order to accelerate electrons emitted from an electron source, a high voltage (Va) of about hundreds of V to several kV or more is applied between the rear plate and the face plate. The brightness of the image-forming apparatus substantially depends upon Va, so that it is required to increase Va in order to obtain high brightness. However, when Va is increased, discharge may occur in the image-forming apparatus. Particularly, in the case where spacer members are disposed in the image-forming apparatus for the purpose of keeping a predetermined interval between the rear plate and the face plate and of supporting the plates against an atmospheric pressure, and in the case where getter members are disposed for the purpose of maintaining a high vacuum state, an electric field is likely to be concentrated in the vicinity of these spacer members and getter members, which may cause discharge.

Furthermore, in the structure in which a supporting frame is disposed in the vicinity of anode electrodes so as to miniaturize the image-forming apparatus, surface creepage may occur via the surface of the supporting frame.

The above-mentioned discharge suddenly occurs during an image display, which may not only disturb an image but also remarkably degrade the electron source in the vicinity of a discharge portion. Accordingly, there is a possibility that a display may not be conducted normally.

SUMMARY OF THE INVENTION

Therefore, with the foregoing in mind, it is an object of the present invention to provide a highly reliable image-forming apparatus that prevents the concentration of an electric field and the occurrence of surface creepage caused by an apparatus configuration, and remarkably reduces damage caused by discharge so as to prevent breakage of the apparatus even in the case where discharge occurs in the apparatus using an electron source, and a method of manufacturing the same.

The present invention relates to an image-forming apparatus in which a rear plate with an electron source disposed thereon and a face plate having an image-forming region that is irradiated with electrons emitted from the electron source to form an image are opposed to each other to constitute a vacuum container.

An image-forming apparatus of the present invention includes: a vacuum container constituted by disposing in opposition to each other a rear plate provided with an electron source formed and a face plate having an image display region provided with at least phosphors for being irradiated with electrons emitted from the electron source to form an image and anodes disposed on the phosphors; anode potential supplying means for supplying to the anode an electric potential higher than that of the electron source; at least one electroconductive member provided at a site outside of the image display region on an inner surface of the face plate; potential supplying means for supplying an electric potential between a lowest electric potential of those which are applied to the electron source and an electric potential applied to the anode to the electroconductive member; and first and second resistant members having a resistance higher than that of the anode and having different resistances from each other, electrically connected between the anode and the electroconductive members, wherein the anode, the first resistant member, the second resistant member, and the electroconductive member are electrically connected in series.

Furthermore, according to another structure of the present invention, an image-forming apparatus includes: a vacuum container constituted by disposing in opposition to each other a rear plate provided with an electron source formed thereon, and a face plate having an image display region that is provided with at least phosphors for being irradiated with electrons emitted from the electron source to form an image and anodes disposed on the phosphors; anode potential supplying means for supplying to the anode an electric potential higher than that of the electron source; at least one electroconductive member provided at a site outside of the image display region on an inner surface of the face plate; potential supplying means for supplying an electric potential at a level between a lowest electric potential of those which are applied to the electron source and an electric potential applied to the anode to the electroconductive member; and a resistant member with a resistance higher than that of the anode, electrically connected between the anode and the electroconductive member, wherein the resistant member is composed of a first resistant member having a sheet resistance $R_1$ on a side closer to the anode, and a second resistant member having a sheet resistance $R_2$ on a side closer to the electroconductive member, the first resistant member and the second resistant member are electrically connected in series from the anode to the electroconductive member, and $R_2$ is larger than $R_1$.

Furthermore, according to still another structure of the present invention, an image-forming apparatus includes: a vacuum container constituted by disposing in opposition to each other a rear plate provided with an electron source formed thereon and a face plate having an image display region provided with at least phosphors for being irradiated with electrons emitted from the electron source to form an image and anode disposed on the phosphors; anode potential supplying means for supplying to the anode an electric potential higher than that of the electron source; a first resistant member with a resistance higher than that of the anode, provided on an inner surface of the face plate; a second resistant member having a resistance higher than that of the anode and lower than that of the first resistant member, provided in a site outside of the image display region on the inner surface of the face plate; and potential supplying means for supplying an electric potential at a level between a lowest electric potential of those which are applied to the electron source and an electric potential applied to the anode to the second resistant member, wherein the first resistant member is positioned between the anode and the second resistant member, and the anode, the first resistant member, and the second resistant member are electrically connected in series.

These and other advantages of the present invention will become apparent to those skilled in the art upon reading and understanding the following detailed description with reference to the accompanying figures.

DETAILED DESCRIPTION OF THE PREFERRED EMBODIMENTS

Figure 1:
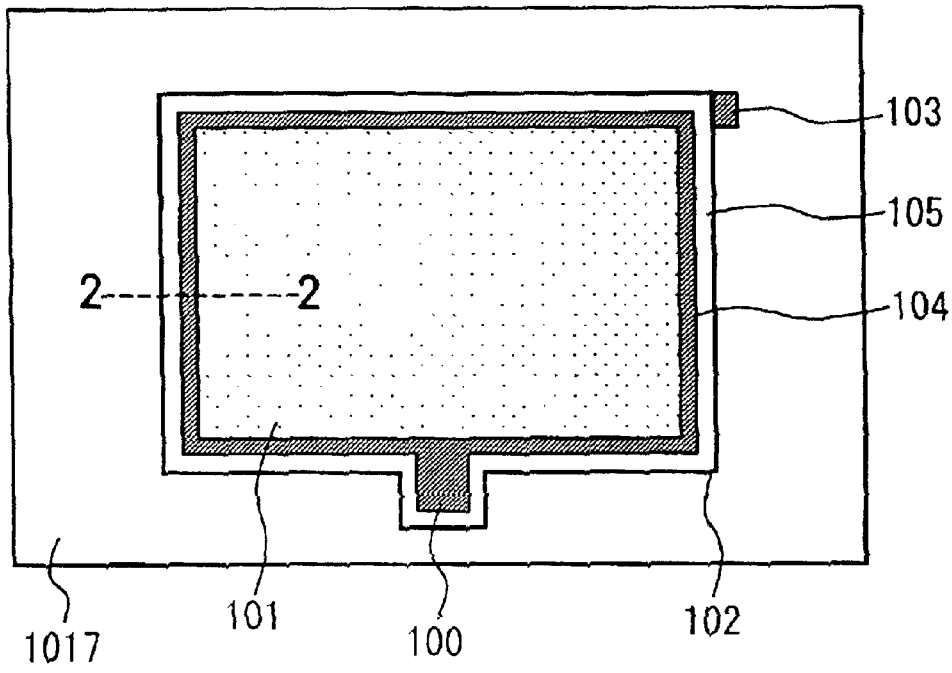
FIG. 1 is a schematic view of a face plate of an image-forming apparatus of an embodiment according to the present invention, seen from an inner surface of a vacuum container.

The present invention relates to an image-forming apparatus in which a rear plate with an electron source disposed thereon and a face plate having an image-forming region that is irradiated with electrons emitted from the electron source to form an image are opposed to each other to constitute a vacuum container.

An image-forming apparatus of the present invention includes: a vacuum container constituted by opposing a rear plate with an electron source formed thereon to a face plate having an image display region that is provided with at least phosphors for being irradiated with electrons emitted from the electron source to form an image and anodes disposed on the phosphors; anode potential supplying means for supplying an electric potential higher than that of the electron source to the anode; at least one electroconductive member provided at a site outside of the image display region on an inner surface of the face plate; potential supplying means for supplying an electric potential between a lowest electric potential of those which are applied to the electron source and an electric potential applied to the anode to the electroconductive member; and first and second resistant members having a resistance higher than that of the anode and having different resistances from each other, electrically connected between the anode and the electroconductive members, wherein the anode, the first resistant member, the second resistant member, and the electroconductive member are electrically connected in series.

According to the above-mentioned structure, since the resistance of the first resistant member is different from that of the second resistant member, the voltage between the anode and the electroconductive member in a normal state is preferentially supplied to any of the first resistant member and the second resistant member, which has a higher resistance. Thus, if discharge should occur, any of the first resistant member and the second resistant member, which has a higher resistance, is short-circuited to cause discharge. When discharge occurs, the resistance of any of the first resistant member and the second resistant member, which has a higher resistance, is negligible, so that a current flowing between the anode and the electroconductive member is determined by any of the first resistant member and the second resistant member, which has a lower resistance. Herein, any of the first resistant member and the second resistant member, which has a lower resistance, has a resistance sufficiently higher than that of the anode. Therefore, due to a current flowing through any of the first resistant member and the second resistant member, which has a lower resistance, the electric potential at a border portion between the first resistant member and the second resistant member change to anode potential or potential of electroconductive member. Because of this, discharge subsides. In this manner, any of the first resistant member and the second resistant member, which has a lower resistance, has a function of current restriction resistance during occurrence of discharge, thereby reducing a discharge current during discharge. As a result, damage such as burning of metal back and peeling of resistant members can be reduced. Furthermore, when a discharge phenomenon subsides, a normal state is obtained again, so that the same effects can be expected to continue thereafter.

Furthermore, according to the above-mentioned structure, the electroconductive member provided in a portion outside of the image display region is supplied with an electric potential between an anode potential and an electric potential applied to the electron source. Therefore, an electric field outside of the image display region is weakened, and discharge (discharge caused by the concentration of an electric field at a getter member and a spacer end portion, creepage discharge on a surface of a supporting frame, etc.) outside of the image display region can be suppressed. Even when discharge occurs in the above-mentioned portion (i.e., any of the first resistant member and the second resistant member, which has a higher resistance), the electric potential of the electroconductive member hardly changes, so that induction of creepage discharge at the supporting frame, discharge in the vicinity of the getter member outside of the image display region, etc. can be prevented by the above-mentioned function.

Furthermore, according to another structure of the present invention, an image-forming apparatus includes: a vacuum container constituted by opposing a rear plate with an electron source formed thereon to a face plate having an image display region that is provided with at least phosphors for being irradiated with electrons emitted from the electron source to form an image and anodes disposed on the phosphors; anode potential supplying means for supplying an electric potential higher than that of the electron source to the anode; at least one electroconductive member provided at a site outside of the image display region on an inner surface of the face plate; potential supplying means for supplying an electric potential between a lowest electric potential of those which are applied to the electron source and an electric potential applied to the anode to the electroconductive member; and a resistant member with a resistance higher than that of the anode, electrically connected between the anode and the electroconductive member, wherein the resistant member is composed of a first resistant member having a sheet resistance $R_1$ on a side closer to the anode, and a second resistant member having a sheet resistance $R_2$ on a side closer to the electroconductive member, the first resistant member and the second resistant member are electrically connected in series from the anode to the electroconductive member, and $R_2$ is larger than $R_1$.

According to the above-mentioned structure, in a normal state, the sheet resistance $R_1$ of the first resistant member and the sheet resistance $R_2$ of the second resistant member have a relationship $R_1 \ll R_2$, so that the electric potential of the first resistant member becomes substantially equal to an anode potential, and a voltage is substantially supplied to the second resistant member. Thus, if discharge should occur in this portion supplied with a voltage, discharge occurs between the resistance border portion between the first resistant member and the second resistant member, and the electroconductive member. When discharge occurs, irrespective of the resistance of the second resistant member, a short-circuit is established between the resistance border portion between the first resistant member and the second resistant member, and the electroconductive member, and a current path with a considerably low resistance is formed. At this moment, the resistance of the second resistant member is negligible, so that a current flowing between the anode and the electroconductive member is determined by the resistance of the first resistant member. Herein, the resistance of the first resistant member has a resistance sufficiently higher than that of the anode. Therefore, due to a current flowing through the first resistant member, the electric potential at the resistance border portion between the first resistant member and the second resistant member is decreased. When the electric potential at the resistance border portion between the first resistant member and the second resistant member is decreased, discharge between the resistance border portion and the electroconductive member subsides. When the discharge is stabilized, the electric potential of the first resistant member is increased to the anode potential. Thus, the first resistant member has a function of current restriction resistance, thereby reducing a discharge current during discharge. As a result, damage such as burning of metal back and peeling of the electroconductive film can be reduced. Furthermore, when a discharge phenomenon subsides, a normal state is obtained again, so that the same effects can be expected to continue thereafter.

Furthermore, according to the above-mentioned structure, an electric potential between the anode potential and the electric potential applied to the electron source is supplied to the electroconductive member provided in a portion outside of the image display region. Therefore, an electric field outside of the image display region is weakened, and discharge (discharge caused by the concentration of an electric field at a getter member and a spacer end portion, creepage discharge on a surface of a supporting frame, etc.) outside of the image display region can be suppressed. Even when discharge occurs in the second resistant member, the electric potential of the electroconductive member hardly changes, so that induction of creepage discharge at the supporting frame, discharge in the vicinity of the getter member outside of the image display region, etc. can be prevented by the above-mentioned function.

Furthermore, according to the above-mentioned structure, the first resistant member on a side closer to the anode has a resistance lower than that of the second resistant member. Therefore, fluctuations in an electric potential of the electroconductive member can be exactly suppressed, which is preferable. During occurrence of discharge, a portion supplied with a high voltage moves immediately from the member with a higher resistance to that with a lower resistance among the first and second resistant members, so that the electric potential of the resistant member with a lower resistance is largely fluctuated. Along with this, the electric potential of members (i.e., those which are positioned at both ends of the resistant member with a lower resistance: the second resistant member and anodes in the present structure) directly connected to the resistant member with a lower resistance also fluctuates. In the present structure, the resistant member with a lower resistance corresponds to the first resistant member on a side closer to the anode. Therefore, the electroconductive member is not influenced by the fluctuations in an electric potential. Thus, induction of discharge in these portions can be more exactly prevented without influencing the electric field of the surface of the supporting frame, the getter member outside of the image display region, etc.

Furthermore, according to still another structure of the present invention, an image-forming apparatus includes: a vacuum container constituted by opposing a rear plate with an electron source formed thereon to a face plate having an image display region that is provided with at least phosphors for being irradiated with electrons emitted from the electron source to form an image and anodes disposed on the phosphors; anode potential supplying means for supplying an electric potential higher than that of the electron source to the anode; a first resistant member with a resistance higher than that of the anode, provided on an inner surface of the face plate; a second resistant member with a resistance higher than that of the anode and lower than that of the first resistant member, provided in a site outside of the image display region on the inner surface of the face plate; and potential supplying means for supplying an electric potential between a lowest electric potential of those which are applied to the electron source and an electric potential applied to the anode to the second resistant member, wherein the first resistant member is positioned between the anode and the second resistant member, and the anode, the first resistant member, and the second resistant member are electrically connected in series.

According to the above-mentioned structure, the resistance of the first resistant member is set to be much higher than that of the second resistant member. Thus, in a simplified structure, a current restriction resistance function can be obtained during occurrence of discharge on an inner surface of the face plate, while the concentration of an electric field at a site such as a supporting frame and a getter member. By setting the resistance of the first resistant member to be much higher than that of the second resistant member, preferably, by setting the resistance of the first resistant member to be larger by at least 10000 times than that of the second resistant member, the second resistant member is allowed to have a function as an electroconductive member, as well as a current restriction resistance function. Thus, a more simplified structure can be realized. More specifically, since the second resistant member has a resistance so as to have a function of current restriction resistance, a decrease in an electric potential (voltage drop) occurs in accordance with the position from the potential supplying means in the second resistant member, if the electroconductive member is not provided. However, the resistance of the first resistant member connected in series to the second resistant member is considerably high, so that a voltage drop in the first resistant member becomes dominant, and a voltage drop depending upon the position from the potential supplying means in the second resistant member is almost negligible. On the other hand, based on the same principle as that of the above-described other aspects of the present invention, in a normal state, a high voltage is applied to the first resistant member with a higher resistance, and during occurrence of discharge, the second resistant member with a lower resistance has a function of current restriction resistance. Therefore, a discharge current can be reduced, and damages such as burning of metal back and peeling of the electroconductive member can be reduced. Furthermore, when a discharge phenomenon subsides, a normal state is obtained again, so that the same effects can be expected to continue thereafter.

Furthermore, according to the present invention, it is preferable that the electroconductive member, and the first and second resistant members are disposed around an entire periphery of the image display region. This is effective for overcoming the problem of discharge in the case where the supporting frame is placed close to the image display region when an outside portion of the image display region is narrowed for the purpose saving a space.

Furthermore, according to the present invention, it is preferable that the potential supplying means supplies a ground potential.

Furthermore, according to the present invention, it is preferable that the first and second resistant members have a sheet resistance of $10^3$ Ω/square to $10^{14}$ Ω/square. In this case, a current restriction resistance function is obtained more exactly.

Furthermore, it is more preferable that the first and second resistant members have a sheet resistance of $10^7$ Ω/square to $10^{14}$ Ω/square. This is because a current restriction resistance function can be obtained while power consumption in the image display apparatus is suppressed.

Furthermore, according to the present invention, it is preferable that one of sheet resistances of the first resistant member and the second resistant member is larger by at least 100 times than the other. In this case, a resistance distribution of the first resistant member and the second resistant member becomes clear, and a voltage is applied to the resistant member with a higher resistance more exactly, so that discharge which may establish a short-circuit between the first resistant member and the second resistant member can be avoided more exactly.

Furthermore, according to the present invention, it is preferable that the first and second resistant members have a sheet resistance of $10^7$ Ω/square to $10^{14}$ Ω/square, and the resistance of the second resistant member is larger by at least 100 times than that of the first resistant member. In this case, a current restriction resistance effect can be obtained more exactly.

Furthermore, according to the present invention, it is preferable that the first resistant member and the second resistant member are allowed to have different resistances by setting thicknesses thereof to be different from each other.

Furthermore, according to the present invention, it is preferable that a connecting site between the first resistant member and the second resistant member has a second electroconductive member. In this case, by forming the second electroconductive member (hereinafter, which may be referred to as an "intermediate electrode") at the resistance border portion between the first resistant member and the second resistant member, electrical connection between the first resistant member and the second resistant member can be more exactly. Furthermore, if an intermediate electrode with a strong film quality such as a printing electrode is formed, the connecting site is unlikely to be damaged even in the case of discharge, which is more preferable.

Furthermore, according to the present invention, it is preferable that the electron source has a plurality of electron-emitting devices connected via wiring.

Furthermore, according to the present invention, it is preferable that the electron source includes a plurality of electron-emitting devices connected in a matrix via a plurality of row-directional wirings and a plurality of column-directional wirings.

Furthermore, according to the present invention, it is preferable that the electron-emitting devices are cold cathode devices.

Furthermore, according to the present invention, it is preferable that the cold cathode devices are surface conduction electron-emitting devices.

Hereinafter, the present invention will be described by way of an illustrative embodiment. It should be noted that a dimension, a material, a shape, a relative arrangement, etc. of components described in the embodiment are not intended to limit the scope of the invention, unless otherwise specified.

First, the structure of a face plate of the embodiment will be described.

Figure 2:
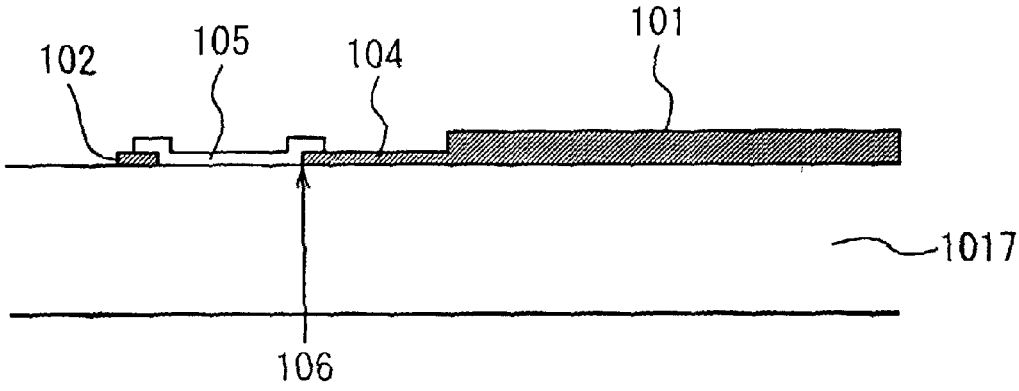
FIG. 2 is a schematic cross-sectional view of the face plate of the image-forming apparatus of the embodiment according to the present invention.

FIG. 1 shows a view of a face plate seen from an inner surface of a vacuum container, and FIG. 2 is a schematic view taken along a line 2—2 in FIG. 1. Various materials (e.g., soda lime glass, soda lime glass with a $SiO_2$ coating formed thereon, glass containing a decreased content of Na, silica glass, etc.) can be used for a face plate substrate, depending upon the conditions.

Reference numeral 100 denotes a high voltage abutting site with respect to a high voltage applying terminal (not shown). An image display region 101 will be described in detail later. Reference numeral 102 denotes an electroconductive member, which is formed on an inner surface of the face plate so as to surround the image display region 101 and the high voltage abutting site 100. Furthermore, a conductive abutting site 103 with an enlarged width so as to be adapted for abutting on an electrode terminal is formed on an upper right corner of the electroconductive member 102 in the drawing. Furthermore, as shown in the figure, a first resistant film (first resistant member) 104 is formed on the image display region 101 side, and a second resistant film (second resistant member) 105 is formed on the electroconductive member 102 side between the image display region 101 and the electroconductive member 102. The resistance of the first resistant film 104 is different from that of the second resistant film 105. More preferably, the resistance of the first resistant film 104 is much smaller than that of the second resistant film 105.

In the case where the electroconductive member 102 is disposed, for example, assuming that the electric potential thereof is equal to that (i.e., 0 volt) of the electron source, an electric field is applied only between the electroconductive member 102 and the image display region 101. More specifically, the electric potential outside of the electroconductive member 102 of the face plate is 0 volt. Thus, in the above-mentioned structure, regarding the withstand voltage outside of the image display region 101, only a creepage withstand voltage between the image display region 101 and the electroconductive member 102 may be considered.

Accordingly, in a region outside of the electroconductive member 102, a structure can be freely disposed without considering a discharge withstand voltage. That is, the distance between the electroconductive member 102 and a supporting frame can be shortened, an apparatus can be miniaturized and light-weight, and the structure in the vicinity of the supporting frame can be made rough. More specifically, it is not required to consider the things that may be conventionally a discharge source, such as the end shape of spacers extending to the vicinity of the supporting frame, getter members, and an adhesive (protrusion of frit glass described later) between the supporting frame and a rear plate.

The resistant films 104 and 105 have a charge prevented function. In the case where electrons reflected from the face plate reach the region between the image display region 101 and the electroconductive member 102, the resistant films 104 and 105 bleed of charge by flowing a trace amount of current. The resistance of the resistant film is preferably $10^3$ Ω/square to $10^{14}$ Ω/square. When considering a power consumption, the resistance is more preferably $10^7$ Ω/square to $10^{14}$ Ω/square.

Hereinafter, the feature of the present embodiment will be described, in which discharge damage is reduced by prescribing the resistance of the first resistant film (resistant member) to be different from that of the second resistant film (resistant member), more preferably by prescribing the resistance of the first resistant film positioned on the anode side so as to be sufficiently smaller than that of the second resistant film. Normally, due to the relationship: the resistance of the first resistant film<< the resistance of the second resistant film (this mean is the resistance of the first resistant film much small the resistance of the second resistant film), the electric potential of the first resistant film 104 becomes substantially equal to an anode voltage Va. Therefore, if discharge should occur between the image display region 101 and the electroconductive member 102, such discharge occurs between a resistance border portion 106 between the first resistant film and the second resistant film and the electroconductive member 102. When discharge occurs, a current path that does not depend upon a resistance value is formed, so that a short circuit is established between the resistance border portion 106 and the electroconductive member 102. At this moment, the resistance of the second resistant film 105 is negligible, so that the current flowing between the image display region 101 and the electroconductive member 102 is determined by the resistance of the first resistant film 104. Since the resistance of the first resistant film is sufficiently higher than that of the image display region 101 (more specifically, metal back), the electric potential of the resistance border portion 106 is decreased due to a flow of a current to the first resistant film 104. When the electric potential of the resistance border portion 106 is decreased, and the discharge between the resistance border portion 106 and the electroconductive member 102 is decreased to be subsided, the electric potential of the first resistant film 104 is increased to that of the anode. In this manner, a discharge current between the resistance border portion 106 and the electroconductive member 102 can be reduced, and a current is prevented from being concentrated at a discharge portion, which reduces damage and prevents an image display apparatus from being broken down. When a discharge phenomenon subsides, a normal state is obtained again; therefore, the same effect can be expected to be maintained.

In the above-mentioned case, compared with one-layered structure in which the resistance of the first resistant member is equal to that of the second resistant member, a portion to be substantially supplied with a high voltage in a normal state (i.e., a portion where any of the first resistant member and the second resistant member, which has a higher resistance, is positioned) is narrow, which is disadvantageous in terms of a discharge withstand. In this case, once discharge occurs, damage is so great that an image display apparatus will not function.

Thus, according to the present invention, there is an effect that damage is reduced even with discharge to some degree, thereby allowing an image display apparatus to be maintained.

Next, a method of manufacturing a face plate will be described.

As a face plate substrate, soda lime glass provided with a $SiO_2$ layer is used. First, an electroconductive member is formed so as to surround a high voltage applying terminal abutting portion and an image display region by printing an Ag paste. The width of the electroconductive member is 2 mm, and surrounds the image display region at a distance of 4 mm.

Figure 3:
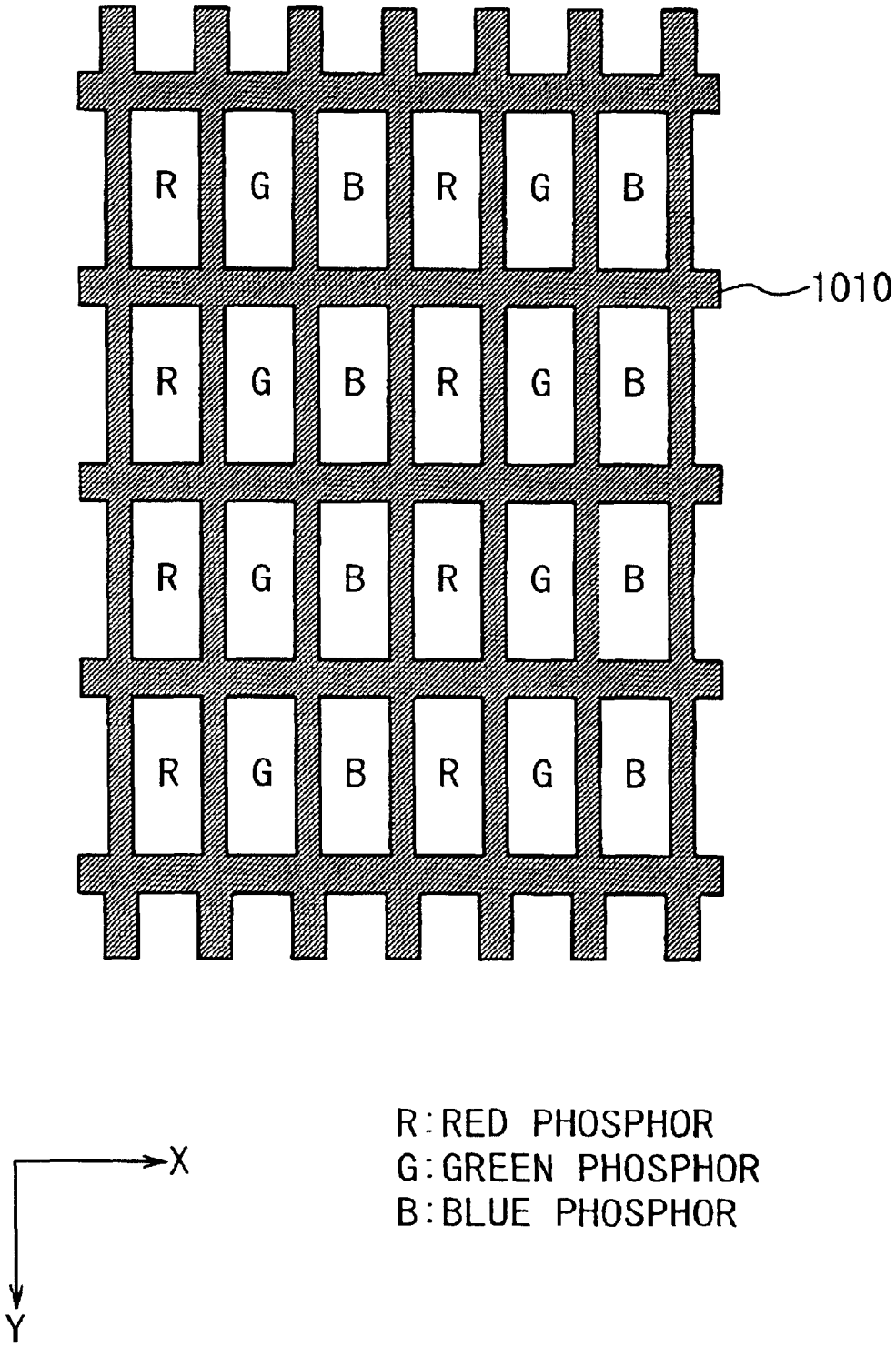
FIG. 3 is a schematic plan view showing a structure of a black matrix.
Figure 4A:
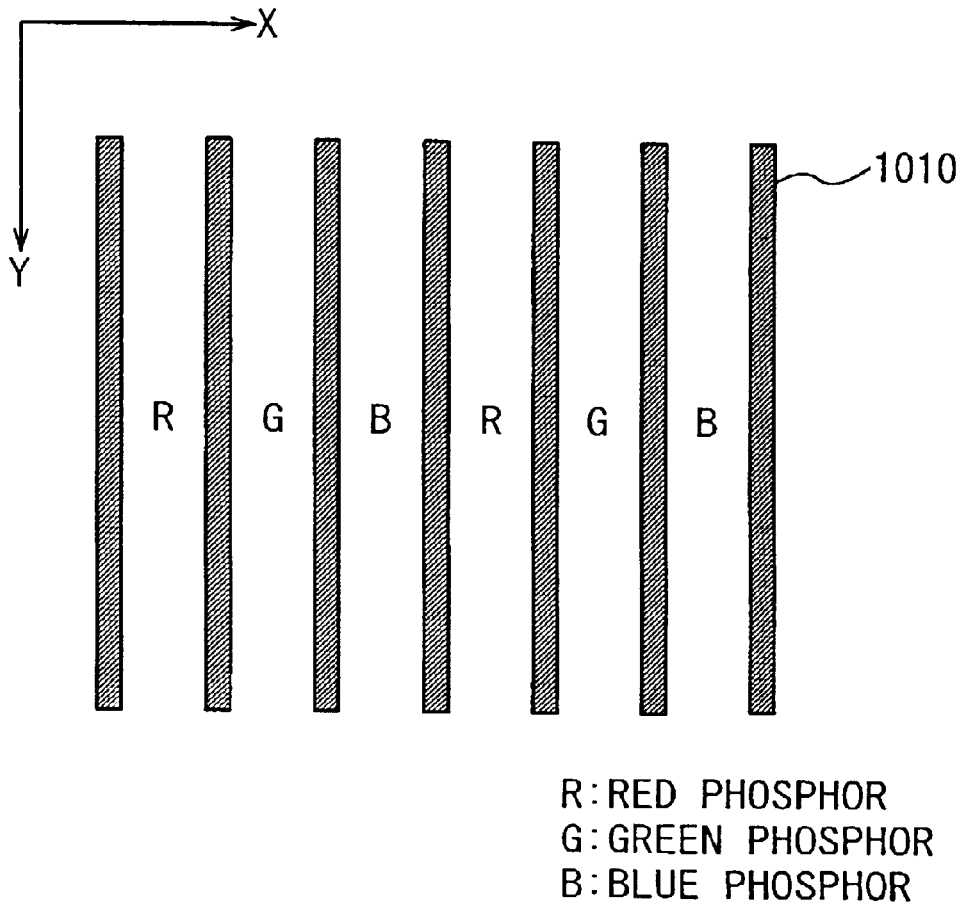
FIGS. 4A and 4B are schematic plan views showing another structure of a black matrix.

Next, a black matrix 1010 is formed in a matrix by screen printing, using a black pigment paste containing a glass paste and a black pigment, as shown in FIG. 3. In the present embodiment, although the black matrix is produced by screen printing, the present invention is not limited thereto. For example, photolithography may be used. Furthermore, although a black pigment paste containing a glass paste and a black pigment is used as a material for the black matrix 1010, the present invention is not limited thereto. For example, carbon black or the like may be used. Furthermore, although the black matrix 1010 is formed in a matrix as shown in FIG. 3 in the present embodiment, the present invention is not limited thereto. The black matrix 1010 may be formed in a stripe arrangement (e.g., FIG. 4A), a delta arrangement (e.g., FIG. 4B), or in other arrangements.

Figure 4B:
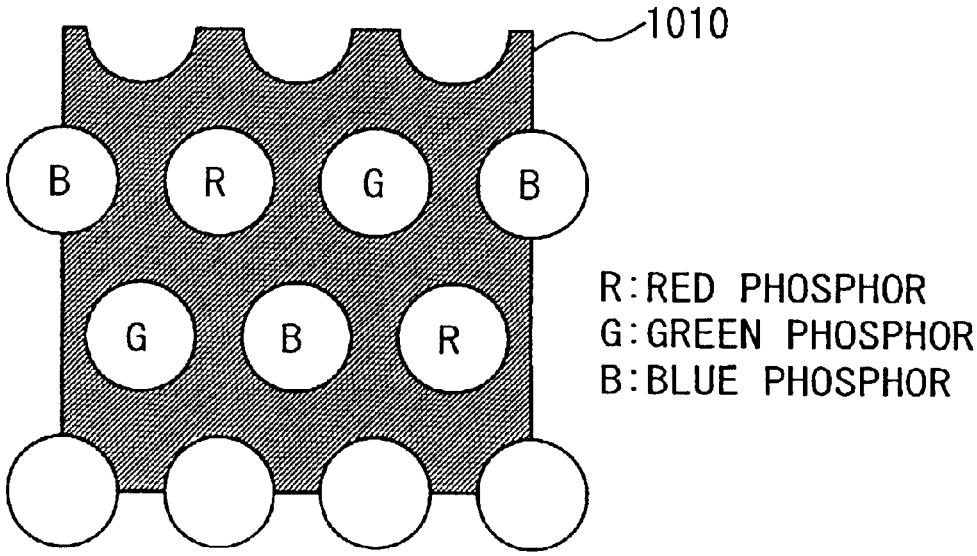

Next, as shown in FIG. 3, phosphors are produced in a stripe shape in opening portions of the black matrix 1010 by screen printing, using phosphor pastes of red, blue, and green. The present invention is not limited thereto. For example, the phosphors may be produced by photolithography. Furthermore, the phosphors may not be arranged in a stripe shape. The phosphors may be formed in a delta arrangement as shown in FIG. 4B, or in other arrangements in accordance with the above-mentioned black matrix.

Next, a resin intermediate film is formed in a filming step that is known in the field of a CRT, and thereafter, a metal vapor-deposited film (Al in the present embodiment) is produced. Finally, the resin intermediate film is removed by thermal decomposition, thereby producing a metal back 1019.

Furthermore, for the purpose of applying an accelerated voltage and enhancing the conductivity of a phosphor film, a transparent electrode made of ITO, ATO, tin oxide, or the like may be provided between a face plate substrate 1017 and a phosphor film 1018. The production order of resistant films 104 and 105 are not particularly limited. They may be formed between any of the above steps. However, in the case where masking is required for film formation as in sputtering, in order to prevent the phosphors and metal back that constitute an image display region from being damaged or contaminated by a mask, masking is preferably conducted before forming the phosphors and metal back, so as to decrease a possibility of disturbing the image display region.

Figure 5:
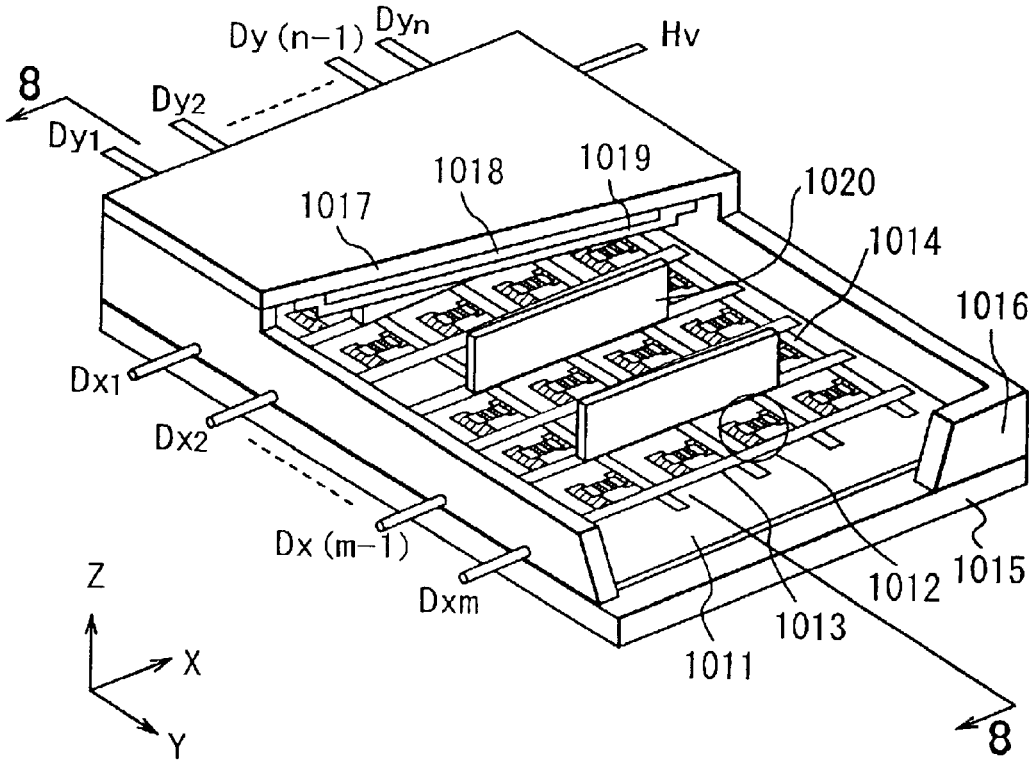
FIG. 5 is a schematic perspective view of a display panel used in the embodiment according to the present invention.

Next, the structure of a display panel of an image-forming apparatus to which the present invention is applied and a method of manufacturing the same will be described by way of a specific example. FIG. 5 is a perspective view of a display panel used in the present embodiment, in which a part of the panel is cut away so as to show an internal structure.

In FIG. 5, reference numeral 1015 denotes a real plate, 1016 denotes a side wall (supporting frame), and 1017 denotes a face plate, which constitute an airtight container for maintaining the inside of the display panel in a vacuum state. In assembling the airtight container, sealing is required for retaining sufficient strength and airtightness at a connecting portion of each member. Such sealing is achieved, for example, by coating a connecting portion with frit glass, followed by sintering at 400° C. to 500° C. for at least 10 minutes in the air or a nitrogen atmosphere. A method for exhausting the inside of the airtight container to a vacuum will be described later. Furthermore, since the inside of the airtight container is retained in a vacuum state of about $10^{-4}$ [Pa], spacers 1020 are provided as an anti-atmospheric pressure structure, for the purpose of preventing the airtight container from being broken down by the atmospheric pressure or sudden shock.

Next, electron-emitting device substrate that can be used in an image-forming apparatus of the present embodiment will be described.

The electron source substrate used in the image-forming apparatus is obtained by arranging a plurality of cold cathode devices on a substrate. Examples of an arrangement of cold cathode devices include a ladder-like arrangement (hereinafter, referred to as a "arrangement electron source substrate" in which cold cathode devices are arranged in parallel, and both ends of each device are connected via wiring, and a simple matrix arrangement (hereinafter, referred to as a "matrix-type arrangement electron source substrate") in which X-directional wirings and Y-directional wirings of a pair of device electrodes of cold cathode devices are connected. An image-forming apparatus having a ladder-like arrangement electron source substrate requires a control electrode (grid electrode) for controlling flying of electrons from an electron-emitting device.

A substrate 1011 is fixed to a rear plate 1015. On the substrate 1011, N×M cold cathode devices 1012 are formed (N and M are positive integers of 2 or more, and appropriately set in accordance with the intended number of display pixels. For example, in a display apparatus intended for a display of a high quality TV, it is desirable to set N to be at least 3000 and M to be at least 1000). The N×M cold cathode devices are connected via a simple matrix wiring, using M row-directional wirings 1013 and N column-directional wirings 1014. A portion constituted by the substrate 1011, the N×M cold cathode devices 1012, the M row-directional wirings 1013, and the N column-directional wirings 1014 is referred to as a multi-electron beam source. As long as the multi-electron beam source used in the image display apparatus is an electron source in which cold cathode devices are connected via a simple matrix wiring or disposed in a ladder-like arrangement, a material, a shape, or a production method of the cold cathode devices are not particularly limited. Thus, for example, a surface conduction electron-emitting device, or an FE-type or MIM-type cold cathode devices can be used.

Next, the structure of a multi-electron beam source will be described in which surface conduction electron-emitting devices are arranged on a substrate as cold cathode devices and connected via a simple matrix wiring.

Figure 6:
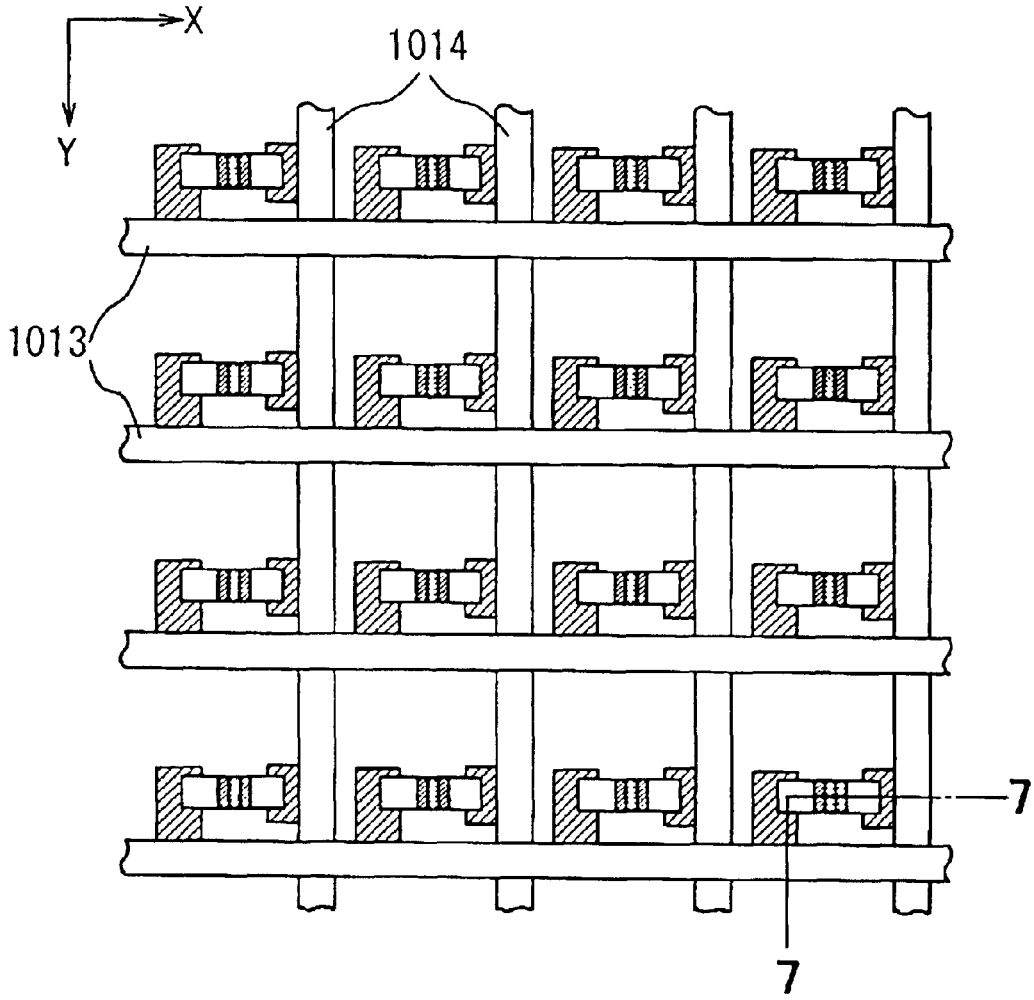
FIG. 6 is a schematic plan view of a multi-electron beam source used in the display panel in FIG. 5.
Figure 7:
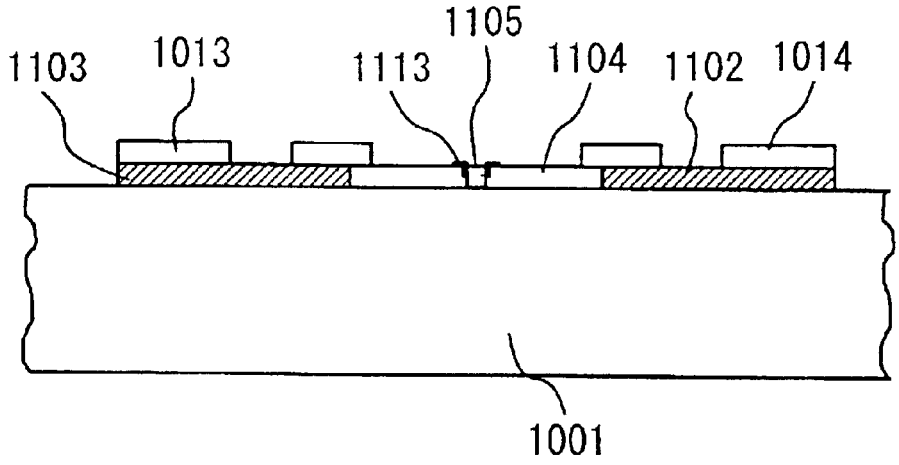
FIG. 7 is a schematic cross-sectional view of the multi-electron beam source used in the display panel in FIG. 5, taken along a line 7—7 in FIG. 6.

FIG. 6 is a plan view of a multi-electron beam source used in the display panel in FIG. 5. On the substrate 1011, surface conduction electron-emitting devices are arranged and connected in a simple matrix by the row-directional wirings 1013 and the column-directional wirings 1014. At each crossing portion between the row-directional wirings 1013 and the column-directional wirings 1014, an insulating layer (not shown) is formed between electrodes so that electrical insulation is established. FIG. 7 shows a cross-sectional view taken along a line 7—7 in FIG. 6. The multi-electron source with the above-mentioned structure is produced by previously forming the row-directional wirings 1013, the column-directional wirings 1014, the insulating layer (not shown) between electrodes, and device electrodes and conductive thin films of the surface conduction electron-emitting devices on a substrate, and supplying voltage to each device through the row-directional wirings 1013 and the column-directional wirings 1014 to conduct an energization forming operation and an activation operation.

Figure 8:
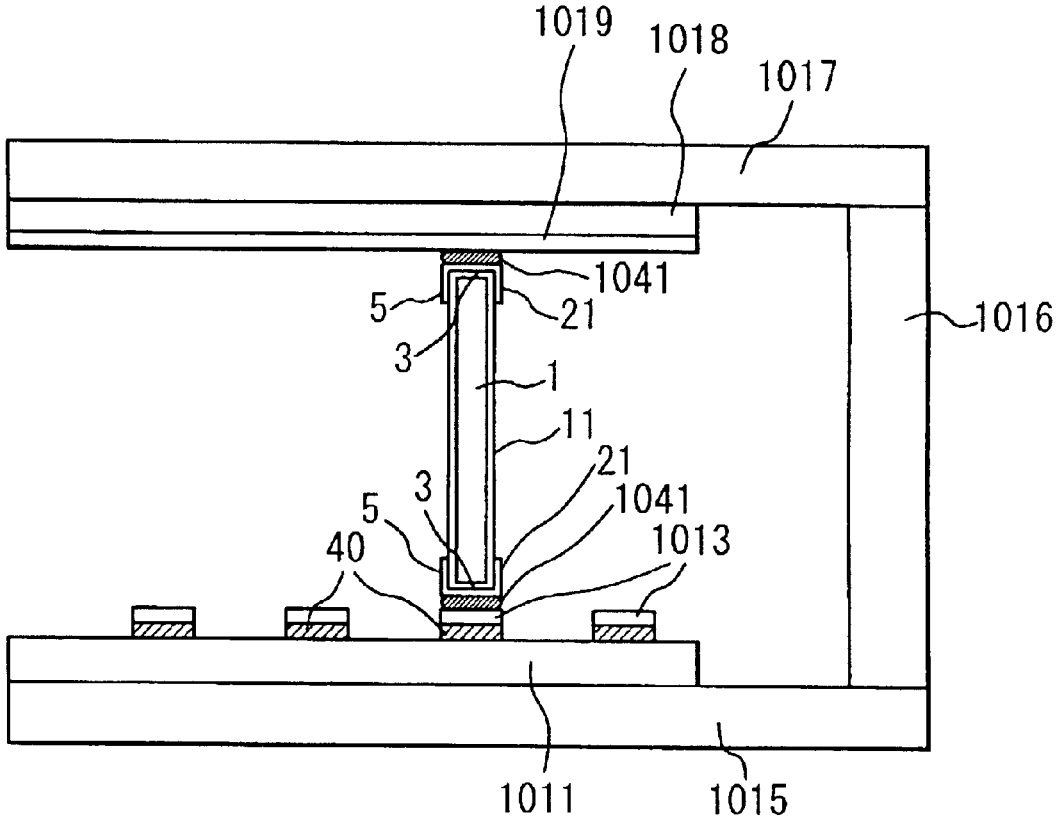
FIG. 8 is a schematic cross-sectional view of the multi-electron beam source used in the display panel in FIG. 5, taken along a line 8—8 in FIG. 5.

In the present embodiment, although the substrate 1011 of the multi-electron beam source is fixed to the rear plate 1015 of the airtight container, in the case where the substrate 1011 of the multi-electron beam source has sufficient strength, the substrate 1011 of the multi-electron beam source may be used as the rear plate of the airtight container. FIG. 8 is a schematic cross-sectional view taken along a line 8—8 in FIG. 5. Each reference numeral in FIG. 8 corresponds to that in FIG. 5. The spacer 1020 is composed of a member obtained by forming an electroconductive film 11 for prevent a charge on surface of an insulating member 1, and forming low resistant films 21 on abutting surfaces 3 of the spacer facing an inside (metal back 1019, etc.) of the face plate 1017 and the surface of the substrate 1011 (row-directional wirings 1013 or the column-directional wirings (not shown)) and side surface portions 5 contacting therewith. The spacers 1020 are disposed in a required number at a required interval for achieving the above-mentioned object, and fixed to the inside of the face plate 1017 and the surface of the substrate 1011 via connecting members 1014. Herein, as described above, in order to avoid discharge caused by concentration of an electric field at spacer end portions, it is preferable to use spacers longer than the image display region so that the end portions of the spacers are positioned outside of the image display region. Furthermore, the electroconductive film 11 is formed at least a surface of the insulating member 1 exposed to a vacuum in the airtight container, and electrically connected to the inside (metal back 1019, etc.) of the face plate 1017 and the surface of the substrate 1011 (row-directional wirings 1013 or column-directional wirings (not shown)) via the low resistant films 21 and the connecting members 1041. In the embodiment described here, the spacers 1020 has a thin plate shape, and are arranged in parallel with the row-directional wirings 1013 so as to be electrically connected thereto. In FIG. 8, reference numeral 40 denotes an insulating layer, which insulates the column-directional wirings (not shown) from the row-directional wirings 1013.

The spacers 1020 are required to have an insulating property that can withstand a high voltage applied between the row-directional wirings 1013 and the row-directional wirings 1014 on the substrate 1011, and the metal back 1019 on the inner surface of the face plate 1017, and conductivity to such a degree as to prevent charge on the surface of the spacers 1020. The connecting members 1041 are required to have conductivity so as to electrically connect the spacers 1020 to the row-directional wirings 1013 and the metal back 1019. More specifically, as the connecting members 1041, frit glass with a conductive adhesive material, metal particles, or an electroconductive filler added thereto is preferable. In order to exhaust the inside of the airtight container to a vacuum, after the airtight container is assembled, an exhaust pipe and a vacuum pump (not shown) are connected to each other, and the airtight container is exhausted to a vacuum degree of about $10^{-5}$ [Pa]. Thereafter, the exhaust tube is sealed. In order to maintain a vacuum degree in the airtight container, immediately before or after sealing, a getter film (not shown) is formed at a predetermined position in the airtight container. The getter film is formed, for example, by heating a getter material mainly containing Ba with a heater or high-frequency heating to vapor-deposit the material. Due to an adsorption function of the getter film, the vacuum degree in the airtight container is maintained at $10^{-3}$ to $10^{-5}$ [Pa].

Figure 12:
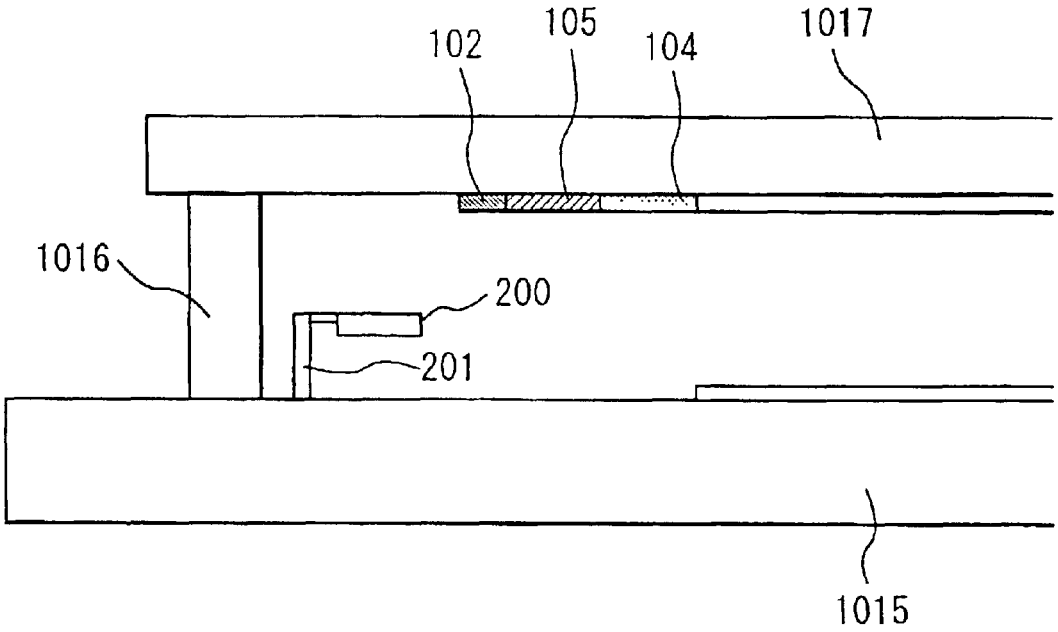
FIG. 12 is a schematic view of a display panel seen in a horizontal direction of an image display surface.

FIG. 12 shows a partial cross-sectional view of an image-forming apparatus in the vicinity of a getter setting portion. (In FIG. 12, reference numeral 20 denotes a getter member before flashing, and 201 denotes a getter member supporter).

In an image display apparatus using the display panel as described above, when a voltage is applied to each cold cathode device 1012 through terminals outside of the container Dx1 to Dxm and Dy1 to Dyn, electrons are emitted from each cold cathode device 1012. The display panel also has anode potential supplying means for supplying a high voltage of hundreds of V to several kV to the metal back 1019 through a terminal outside of the container Hv. When a high voltage is applied to the metal back 1019, the emitted electrons are accelerated to bump into the inner surface of the face plate 1017. Because of this, phosphors of each color forming the phosphor film 1018 are excited to emit light, thereby displaying an image. Although not shown in FIG. 5, at a position diagonal to the terminal outside of the container Hv, a terminal outside of the container Lv electrically connected to the conductive abutting site 103 and potential supplying means electrically connected to the terminal Lv are provided for the purpose of supplying an electric potential to the electroconductive member 102, whereby an electric potential between the lowest potential applied to the electron source and the potential applied to the anode (metal back) is supplied.

In general, a voltage of about 12 to 16 volts is supplied to the surface conduction electron-emitting devices 1012 in the present invention, which are cold cathode devices, by applying a voltage of −6 to −8 volts and 6 to 8 volts to Dx1 to Dxm and Dy1 to Dyn, respectively. A distance d between the metal back 1019 and the cold cathode devices 1012 is about 0.1 mm to 8 mm, and a voltage between the metal back 1019 and the cold cathode devices 1012 is about 0.1 kV to about 20 kV.

The basic structure and production method of the display panel of the embodiment according to the present invention, and the summary of the image display apparatus have been described.

EXAMPLES

In Examples 1 to 6 and 8, a resistant film that is a resistant member is formed by masking with a mask having openings for film-formation portions, followed by sputtering, before forming a black matrix. In Example 7, after a black matrix is formed, a film to be a resistant member is formed by masking with a mask having openings for film-formation portions, followed by sputtering, or the like. These are merely examples. Other film-formation methods may be used. In each example, the order of forming a black matrix and a resistant member may be changed. This change will not cause the effects of the present invention to be lost. Furthermore, in each example, a plane structure of a face plate is similar to that of the schematic structure in FIG. 1. Therefore, the description thereof will be omitted here.

Example 1

Figure 9:
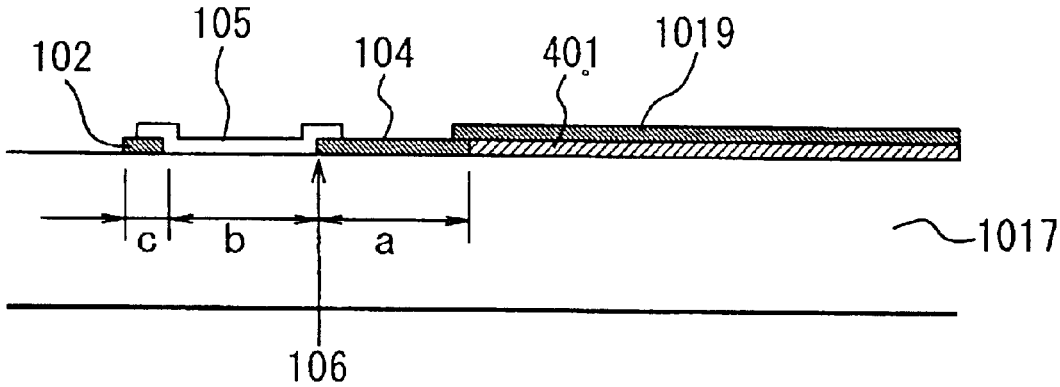
FIG. 9 is a schematic cross-sectional view showing a resistant film portion of an image-forming apparatus of Example 1 according the present invention.

In the present example, two kinds of resistant films are formed between an image display region and an electroconductive member. FIG. 9 is a cross-sectional view showing the resistant films. Herein, reference numeral 1017 denotes a face plate substrate, 1019 denotes a metal back, 102 denotes an electroconductive member, 104 denotes a first resistant film (first resistant member), 105 denotes a second resistant film (second resistant member), 106 denotes a resistance border portion, and 401 denotes phosphors and a black matrix. The metal back 1019 and the phosphors and the black matrix 401 constitute an image display region.

First, as the first resistant film 104, WGeN (nitride of tungsten and germanium) was formed to a film with a thickness of about 250 [nm]. The first resistant film 104 was formed by sputtering for 20 minutes under the conditions of a total pressure of 1.5 [Pa], an Ar flow rate of 50 [sccm], an $N_2$ flow rate of 5 [sccm], and a W input power of 239 [W], and a Ge input power of 600 [W], whereby a sheet resistance of about $4\times10^9$ [Ω/square] was obtained. Then, as the second resistant film 105, AlN (aluminum nitride) was formed to a film with a thickness of about 50 [nm]. The second resistant film 105 was formed by sputtering for 10 minutes under the conditions of a total pressure of 1.5 [Pa], an Ar flow rate of 50 [sccm], an $N_2$ flow rate of 10 [sccm], and an Al input power of 1200 [W], whereby a sheet resistance of about $3\times10^{12}$ [Ω/square] was obtained. In FIG. 9, the face plate was designed so as to have a=b=2 [mm] and c=2 [mm], and an actual measurement had a positional precision within 100 [μm] with respect to the designed value.

An image-forming apparatus was formed by using the above-mentioned face plate. Since the resistance of the first resistant film 104 was different from that of the second resistant film 105 by about 700 times, the electric potential of the resistance border portion 106 was considered to be substantially the same as that of the image display region. When an anode voltage Va (10 [kV]) was applied to the image display region, discharge did not occur between the resistance border portion 106 and the electroconductive member 102, and it was possible to allow the image-forming apparatus to display an image without any problem. Furthermore, in order to obtain higher brightness, the anode voltage Va was set to 12 [kV]. At this time, although discharge occurred between the resistance border portion 106 and the electroconductive member 102, the metal back 1019, and the resistant films 104 and 105 were not damaged by the discharge. Thereafter, when the image-forming apparatus was driven for one hour at the anode voltage Va of 12 [kV], discharge was observed 5 times. However, this did not lead to damage, and hence, the continuous effects were confirmed.

Example 2

Figure 10:
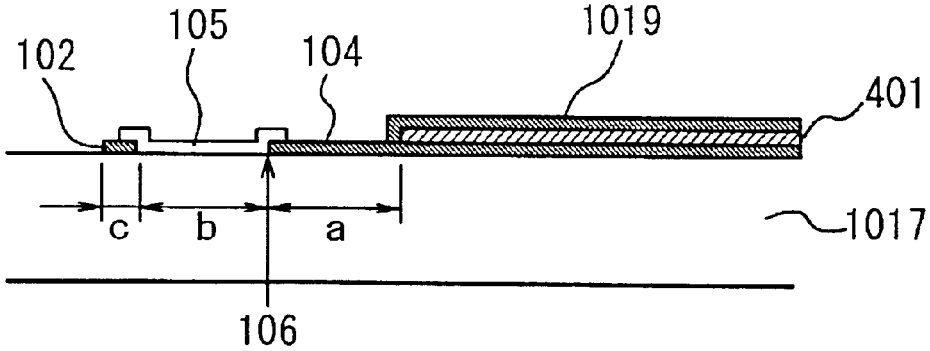
FIG. 10 is a schematic cross-sectional view showing a resistant film portion of an image-forming apparatus of Example 2 according to the present invention.

In the present example, a first resistant film (first resistant member) was made of ITO. FIG. 10 shows a cross-sectional view thereof. Reference numeral 1017 denotes a face plate substrate, 1019 denotes a metal back, 102 denotes a conductive member, 104 denotes a first resistant film, 105 denotes a second resistant film, 106 denotes a resistance border portion, and 401 denotes phosphors and a black matrix. The metal back 1019 and the phosphors and the black matrix 401 constitute an image display region.

In the present example, an ITO film was also formed in the image display region, and the first resistant film 104 was continuously formed (104 in the figure) at the same time under the same conditions as shown in FIG. 10. Furthermore, in the present example, the ITO film was formed before forming the electroconductive member 102 and a high voltage applying terminal abutting portion (not shown). The ITO film has a thickness of about 200 [nm], and a sheet resistance of about $10^6$ [Ω/square] which is sufficiently higher than that of the metal back 1019. As the second resistant film 105, WGeN was formed to a film with a thickness of about 250 [nm]. The second resistant film 105 was formed by sputtering for 20 minutes under the conditions of a total pressure of 1.5 Pa, an Ar flow rate of 50 sccm, an $N_2$ flow rate of 5 sccm, a W electric power of 180 [W], and a Ge electric power of 600 [W], whereby a sheet resistance of about $2\times10^{12}$ [Ω/square] was obtained. In FIG. 10, the face plate was designed so as to have a=b=2 [mm] and c=2 [mm], and an actual measurement had a positional precision within 100 [μm] with respect to the designed value.

An image-forming apparatus was formed by using the above-mentioned face plate. Since the resistance of the first resistant film 104 was different from that of the second resistant film 105 by 6 orders of magnitude, the electric potential of the first resistant film 104 became substantially the same as an anode voltage, whereby the effects similar to those in Example 1 were obtained. In this case, it is possible to more exactly satisfy the relationship: resistance of the first resistant film<<resistance of the second resistant film. Furthermore, in the case where the present invention is applied to a face plate having an ITO film in an image display region, the step of forming only a resistant film is omitted, which is advantageous in terms of time.

Example 3

In the present example, WGeN is used for a resistant film, and sputtering conditions are varied, whereby the resistances of the first and second resistant films are changed. The cross-sectional structure in the present example is the same as that in Example 1 (FIG. 9). Regarding the film-formation conditions, only an input power is changed, and the remaining conditions are a total pressure of 1.5 [Pa], an Ar flow rate of 50 [sccm], an $N_2$ flow rate of 5 [sccm], and a Ge electric power of 600 [W]. In forming the first resistant film, a W (tungsten) input power was set to 230 [W] to obtain a sheet resistance of about $4\times10^9$ [Ω/square]. In forming the second resistant film, a W (tungsten) input power was set to 180 [W] to obtain a sheet resistance of about $2\times10^{12}$ [Ω/square].

An image-forming apparatus was formed by using the above-mentioned face plate. The same effects as those in Example 1 were obtained. In this case, the material of the first resistant film is the same as that of the second resistant film, and characteristics thereof such as a surface energy and, a thermal expansion coefficient are not largely different from each other. Therefore, the continuity of the resistant films at the border portion becomes satisfactory, and a plurality of kinds of sputtering targets are not required to be prepared, which is advantageous in terms of a material cost and an apparatus cost.

Example 4

Figure 11:
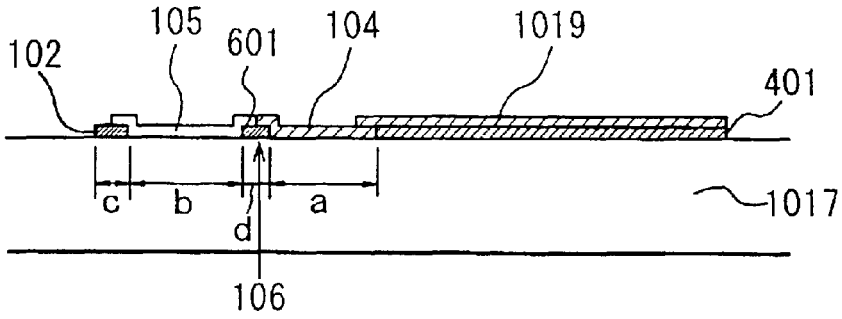
FIG. 11 is a schematic cross-sectional view showing a resistant film portion of an image-forming apparatus of Example 4 according to the present invention.

The present example is different from Example 1 in that an intermediate electrode is provided at a connecting portion. FIG. 11 shows a cross-sectional view thereof. Reference numeral 1017 denotes a face plate substrate, 1019 denotes a metal back, 601 denotes an intermediate electrode, 102 denotes an electroconductive member, 104 denotes a first resistant film, 105 denotes a second resistant film, 106 denotes a resistance border portion, and 401 denotes phosphors and a black matrix. The metal back 1019 and the phosphors and the black matrix 401 constitute an image display region.

The intermediate electrode 601 is printed using an Ag paste in the same way as in the electroconductive member 102, simultaneously when the electroconductive member 102 and a high voltage applying terminal abutting portion (not shown) are formed. Procedures of forming the first and second resistant films are the same as those in Example 1. In FIG. 11, the face plate is designed so as to have a=b=2 [mm], c=2 [mm], and d=1 [mm]. An actual measurement had a positional precision within 100 μm with respect to the designed value.

Discharge started to occur at an anode voltage Va of 12 [kV] in the same way as in Example 1. In the present example, the anode voltage Va was further increased to 13 [kV]. At this time, frequency and magnitude of discharge were increased; however, the intermediate electrode 601 formed by printing had adhesion stronger than that of the first and second resistant films, so that damage was not caused at the connecting portion. Furthermore, the continuous effects were also confirmed.

Example 5

The present example is the same as Example 1, except that the sheet resistance value of the first resistant film is made different. More specifically, the sputtering conditions were varied, whereby the sheet resistance value of the first resistant film was prescribed to be $10^3$ [Ω/square]. In the present example, although a power consumption was slightly increased, the second resistant film more exactly becomes a high voltage application portion in a normal state. Therefore, discharge that may cause a short circuit between the anode portion (specifically, the metal back) and the electroconductive member can be avoided in an exact manner, and a current restriction resistance function is more exactly obtained in the first resistant film. Furthermore, although the sheet resistance of the first resistant film was set to be smaller (i.e., $10^3$ Ω/square) than that in Example 1, it was possible to obtain a sufficient current restriction resistance function during occurrence of discharge.

Example 6

The present example is the same as Example 1, except that the materials of the first and second resistant films (resistant members) in Example 1 are exchanged with each other. More specifically, as the first resistant film 104, AlN was formed to a film with a thickness of about 50 [nm]. The first resistant film 104 was formed by sputtering for 10 minutes under the conditions of a total pressure of 1.5 [Pa], an Ar flow rate of 50 [sccm], an $N_2$ flow rate of 10 [sccm], and an Al input power of 1200 [W], whereby a sheet resistance of about $3\times10^{12}$ [Ω/square] was obtained. As the second resistant film 105, WGeN was formed to a film with a thickness of about 250 [nm]. The first resistant film 105 was formed by sputtering for 20 minutes under the conditions of a total pressure of 1.5 [Pa], an Ar flow rate of 50 [sccm], an $N_2$ flow rate of 5 [sccm], a W (tungsten) input power of 239 [W], and a Ge input power of 600 [W], whereby a sheet resistance of about $4\times10^9$ [Ω/square] was obtained. In FIG. 9, the face plate was designed so as to have a=b=2 [mm] and c=2 [mm]. An actual measurement had a positional precision within 100 [μm] with respect to the designed value. In the structure of the present example, since the resistance of the first resistant film was larger by about 700 times than that of the second resistant film, the electric potential of the resistance border portion 106 was considered to be substantially the same as that of the electroconductive member 102. Herein, when an anode voltage Va of 10 [kV] was applied to the image display region, discharge did not occur between the resistance border portion 106 and the image display region, and it was possible to allow the image-forming apparatus to display an image without any problem.

Furthermore, in order to obtain higher brightness, the anode voltage Va was set to 12 [kV]. At this time, although discharge occurred between the resistance border portion 106 and the image display region, the metal back 1019, and the resistant films 104 and 105 were not damaged by the discharge. Thereafter, when the image-forming apparatus was activated for one hour at the anode voltage Va of 12 [kV], discharge was observed 5 times. However, this did not lead to damage, and hence, the continuous effects were confirmed.

Example 7

Figure 13:
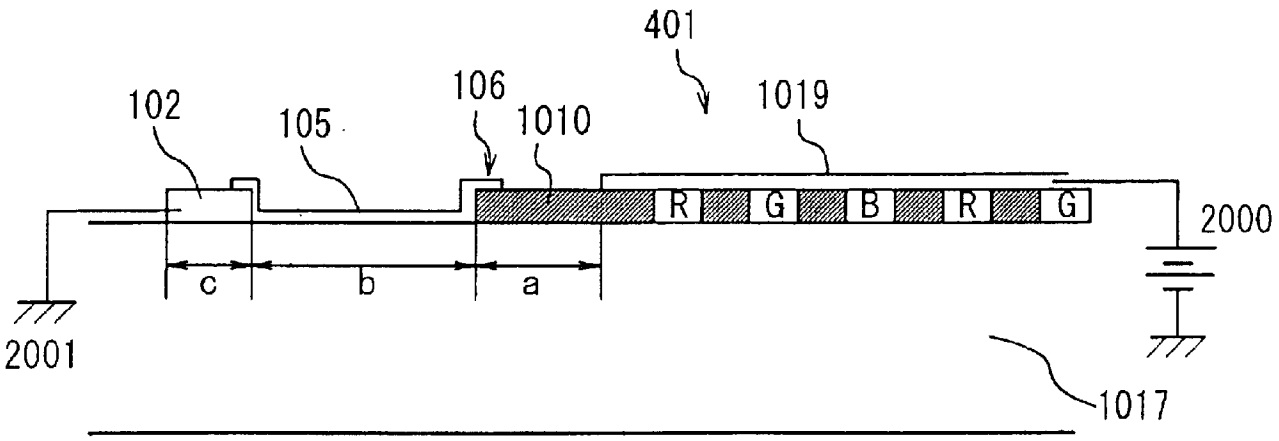
FIG. 13 is a schematic cross-sectional view showing a resistant member portion of an image-forming apparatus of Example 7 according to the present invention.

In the present example, a black matrix (black conductor) 1010, which is one of the components constituting an image display region, was disposed so as to project to an electroconductive member 102 side from a metal back (anode), whereby the outermost periphery of the image display region was defined by the black matrix. The resistance of the black matrix was controlled to be a desired value, and used as a first resistant member. Specifically, the resistance of the black matrix was controlled by appropriately adjusting a mixing ratio between a glass paste, ruthenium oxide and a black pigment. Furthermore, in the present example, after the black matrix 1010 was formed, a second resistant film (second resistant member) was formed as described above. FIG. 13 shows a cross-sectional view of a face plate with the above-mentioned structure. Herein, the black matrix 1010 had a sheet resistance of $10^4$ [Ω/square] and a thickness of 15 [μm]. The second resistant film 105 had a sheet resistance of $10^{13}$ [Ω/square], and was made of a WGeN film with a thickness of 100 [nm]. In FIG. 13, the face plate was designed so as to have a=b=4 [mm] and c=2 [mm]. An image-forming apparatus was formed by using this face plate. Since the resistance of the second resistant film was much higher than that of the black matrix functioning as the first resistant member, the electric potential of a resistance border portion 106 was considered to be substantially the same as an anode potential. When the anode (specifically, metal back) was supplied with an anode voltage Va of 10 [kV], discharge did not occur between the resistance border portion 106 and the electroconductive member 102, and it was possible to allow the image-forming apparatus to display an image without any problem.

Furthermore, in order to obtain higher brightness, the anode voltage Va was set to 12 [kV]. At this time, although discharge occurred between the resistance border portion 106 and the electroconductive member 102, the metal back 1019, the black matrix 1010, and the resistant film 105 were not damaged by the discharge. Thereafter, when the image-forming apparatus was activated for one hour at the anode voltage Va of 12 [kV], discharge was observed 5 times. However, this did not lead to damage in the same way as in Example 1, and hence, the continuous effects were confirmed.

In Examples 1 to 7, since an electric potential was supplied to the electroconductive member provided in a portion outside of the image display region, even when discharge occurred in the above-mentioned portion (i.e., any of the first resistant member and the second resistant member, which has a higher resistance), the electric potential of the electroconductive member was not varied. Thus, it was possible to prevent induction of creepage discharge at the supporting frame, discharge in the vicinity of a getter member outside of the image display region, etc.

Example 8

Figure 14:
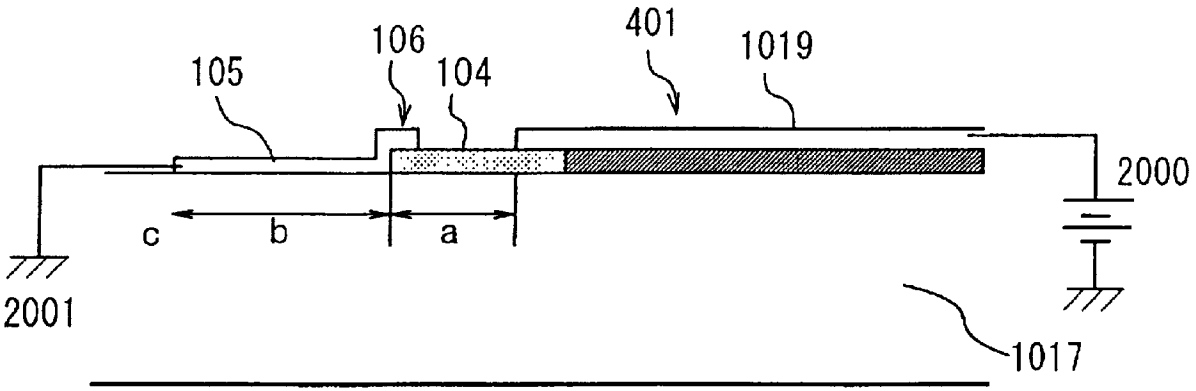
FIG. 14 is a schematic cross-sectional view showing a resistant member portion of an image-forming apparatus of Example 8 according to the present invention.

The present example is the same as Example 6, except that the electroconductive member 102 in Example 6 is omitted to simplify a faceplate structure, and the sheet resistances of the first resistant film 104 and the second resistant film 105 are changed to $10^{14}$ [Ω/square] and $10^3$ [Ω/square], respectively. FIG. 14 shows a cross-sectional view of the face plate of the present example. In FIG. 14, the face plate was designed so as to have a=b=4 [mm]. In the structure of the present example, since the resistance of the first resistant film 104 is much higher than that of the second resistant film 105, in a normal state, the second resistant film 105 functions as an electroconductive member, and an resistance border portion 106 is grounded (GND). When an anode (specifically, metal back) was supplied with an anode voltage Va of 10 [kV], discharge did not occur between the resistance border portion 106 and the image display region, and it was possible to allow the image-forming apparatus to display an image without any problem. Furthermore, in order to obtain higher brightness, the anode voltage Va was set to 12 [kV]. At this time, although discharge occurred between the resistance border portion 106 and the image display region, the metal back 1019, and the resistant films 104 and 105 were not damaged by the discharge. Thereafter, when the image-forming apparatus was activated for one hour at the anode voltage Va of 12 [kV], discharge was observed 5 times. However, this did not lead to damage in the same way as in Example 6, and hence, the continuous effects were confirmed.

As described above, according to the present invention, a highly reliable image-forming apparatus can be realized, which prevents the concentration of an electric field and the occurrence of surface creepage caused by an apparatus configuration, and remarkably reduces damage caused by discharge so as to prevent breakage of the apparatus even in the case where discharge occurs in a portion where the resistant member is formed in the apparatus using an electron source.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method of driving an image-forming apparatus comprising a vacuum container constituted by disposing in opposition to each other a rear plate provided with an electron source formed thereon, and a face plate having an image display region provided with at least phosphors for being irradiated with electrons emitted from the electron source to form an image, and an anode disposed on the phosphors, an electroconductive member is provided at a site outside of the image display region on an inner surface of the face plate, and first and second resistant members having resistances higher than that of the anode and having different resistances from each other, are electrically connected between the anode and the electroconductive member, and the anode, the first resistant member, the second resistant member, and the electroconductive member are electrically connected in series, the method comprising the steps of determining a voltage of the anode and the electroconductive member, so that a voltage of the anode is higher than a voltage of the electroconductive member, thereby setting at a normal state voltages applied to the first and second resistant members, changing from the normal state the voltage applied to at least one of the first and second resistant members, and returning to the normal state the voltage changed in the changing and applied to the at least one of the first and second resistant members.

2. A method according to claim 1, wherein the electroconductive member and the first and second resistant members are disposed around an entire periphery of the image display region.

3. A method according to claim 1, wherein the electroconductive member is set at a ground potential.

4. A method according to claim 1, wherein a sheet resistance of one of the first resistant member and the second resistant member is at least 100 times larger than that of another one of the first and second resistant members.

5. A method of driving an image-forming apparatus comprising a vacuum container constituted by disposing in opposition to each other a rear plate provided with an electron source formed thereon, and a face plate having an image display region provided with at least phosphors for being irradiated with electrons emitted from the electron source to form an image, and an anode disposed on the phosphors, wherein an electroconductive member is provided at a site outside of the image display region on an inner surface of the face plate, a resistant member with a resistance higher than that of the anode is electrically connected between the anode and the electroconductive member, the resistant member is composed of a first resistant member having a sheet resistance $R_1$ on a side adjacent the anode, and a second resistant member having a sheet resistance $R_2$ on a side adjacent the electroconductive member, the first resistant member and the second resistant member are electrically connected in series from the anode to the electroconductive member, and $R_2$ is larger than $R_1$, the method comprising the steps of determining a voltage of the anode and the electroconductive member, so that a voltage of the anode is higher than a voltage of the electroconductive member, thereby setting at a normal state voltages applied to the first and second resistant members, changing from the normal state the voltage applied to the first resistant member, and returning to the normal state the voltage changed in the changing and applied to the first resistant member.

6. A method according to claim 5, wherein the electroconductive member and the first and second resistant members are disposed around an entire periphery of the image display region.

7. A method according to claim 5, wherein the electroconductive member is set at a ground potential.

8. A method according to claim 5, wherein the first and second resistant members have a sheet resistance of about $10^3$ Ω/square to $10^{14}$ Ω/square.

9. A method according to claim 5, wherein the first and second resistant members have a sheet resistance of about $10^7$ Ω/square to $10^{14}$ Ω/square.

10. A method according to claim 5, wherein the sheet resistance of the second resistant member is larger by at least 100 times than the sheet resistance of the first resistant member.

11. A method according to claim 5, wherein the first resistant member and the second resistant member have a sheet resistance of about $10^7$ Ω/square to $10^{14}$ Ω/square, and the sheet resistance of the second resistant member is larger by at least 100 times than the sheet resistance of the first resistant member.

12. A method according to claim 5, wherein the first resistant member and the second resistant member are allowed to have different resistances by setting thicknesses thereof to be different from each other.

13. A method according to claim 5, wherein a connecting site between the first resistant member and the second resistant member has a second electroconductive member.

14. A method of driving an image-forming apparatus comprising a vacuum container constituted by disposing in opposition to each other a rear plate provided with an electron source formed thereon, a face plate having an image display region provided with at least phosphors for being irradiated with electrons emitted from the electron source to form an image, and an anode disposed on the phosphors, wherein an electroconductive member is provided at a site outside of the image display region on an inner surface of the face plate, and first and second resistant members having resistances higher than that of the anode and having different resistances from each other, are electrically connected between the anode and the electroconductive member, and wherein the anode, the first resistant member, the second resistant member, and the electroconductive member are electrically connected in series, the method comprising the steps of:

applying a first voltage between the anode and the electroconductive member, so that a voltage of the anode is higher than a voltage of the electroconductive member, thereby setting at a normal state voltages applied to the first and second resistant members; and applying a second voltage between the anode and the electroconductive member to change, from the normal state, the voltage applied to at least one of the first and second resistant members, wherein the second voltage is set such that, after the step of applying the second voltage, the voltages of the first and second resistant members return to the normal state.

15. A method according to claim 14, wherein the electroconductive member and the first and second resistant members are disposed around an entire periphery of the image display region.

16. A method according to claim 14, wherein the electroconductive member is set at a ground potential.

17. A method according to claim 14, wherein a sheet resistance of one of the first resistant member and the second resistant member is at least 100 times larger than that of another one of the first and second resistant members.

* * * * *

UNITED STATES PATENT AND TRADEMARK OFFICE

CERTIFICATE OF CORRECTION

PATENT NO. : 6,853,148 B2
DATED : February 8, 2005
INVENTOR(S) : Koji Yamazaki et al.

It is certified that error appears in the above-identified patent and that said Letters Patent is hereby corrected as shown below:

Column 3,
Line 55, “according” should read -- according to --.

Column 8,
Line 31, “can be” should read -- can be made --.

Column 9,
Line 42, “prevented” should read -- prevention --;
Line 61, “mean is” should read -- means --; and
Line 62, “much small” should read -- much smaller than --.

Column 11,
Line 34, “real” should read -- rear --; and
Line 59, “arrangement” should read -- ladder-like arrangement --.

Column 12,
Line 57, “vent” should read -- venting --.

Column 13,
Line 11, “has” should read -- have --.

Column 16,
Line 17, “and,” should read -- and --.

Column 18,
Line 42, “faceplate” should read -- face plate --; and
Line 51, “and an” should read -- and a --.

Signed and Sealed this

Twenty-first Day of March, 2006

JON W. DUDAS
*Director of the United States Patent and Trademark Office*